US005517078A

United States Patent [19]

Sugawara et al.

[11] Patent Number: 5,517,078

[45] Date of Patent: May 14, 1996

[54] COLOR CATHODE RAY TUBE APPARATUS

[75] Inventors: Shigeru Sugawara, Saitama; Junichi Kimiya; Eiji Kamohara, both of Fukaya, all of Japan

[73] Assignee: Kabushiki Kaisha Toshiba, Kawasaki, Japan

[21] Appl. No.: 241,588

[22] Filed: May 12, 1994

[30] Foreign Application Priority Data

May 14, 1993 [JP] Japan ..... 5-111986
Nov. 16, 1993 [JP] Japan ..... 5-285422

[51] Int. Cl.[6] ..... H01J 29/46

[52] U.S. Cl. ..... 313/412; 313/414

[58] Field of Search ..... 313/412, 413, 313/414, 428

[56] References Cited

U.S. PATENT DOCUMENTS

| | | | |
|---|---|---|---|
| 2,957,106 | 10/1960 | Moodey . | |
| 3,772,554 | 11/1973 | Hughes . | |
| 4,626,738 | 12/1986 | Gerlach | 313/414 |
| 4,728,859 | 3/1988 | Natsuhara et al. . | |
| 4,766,344 | 8/1988 | Say | 313/414 |
| 4,886,996 | 12/1989 | Yamane et al. | 313/414 |
| 4,887,001 | 12/1989 | D'Amato et al. . | |
| 4,897,575 | 1/1990 | Shimoma et al. . | |
| 5,027,043 | 6/1991 | Chen et al. | 313/412 |
| 5,034,652 | 7/1991 | Shimona et al. | 313/412 |
| 5,091,673 | 2/1992 | Shimona et al. | 313/412 |
| 5,146,133 | 11/1992 | Shirai et al. | 313/414 |
| 5,170,101 | 12/1992 | Gorski et al. | 313/412 |
| 5,202,604 | 4/1993 | Kweon | 313/412 |
| 5,300,854 | 4/1994 | Kweon | 313/412 |

FOREIGN PATENT DOCUMENTS

| | | |
|---|---|---|
| 0119276 | 9/1984 | European Pat. Off. . |
| 0333488 | 9/1989 | European Pat. Off. . |
| 0487139 | 5/1992 | European Pat. Off. . |
| 2559948 | 8/1985 | France . |
| 4267037 | 9/1992 | Japan . |
| 53695 | 1/1993 | Japan . |

*Primary Examiner*—Sandra L. O'Shea
*Assistant Examiner*—Vip Patel
*Attorney, Agent, or Firm*—Cushman Darby & Cushman

[57] ABSTRACT

In a color cathode ray tube apparatus including an electron gun assembly having a main electron lens section for focusing and converging three electron beams arranged in a line on a phosphor screen, three electron beam through holes arranged in a line in the arrangement direction of the three electron beams are formed in each of the opposing surfaces of the first electrode having a relatively low potential and a second electrode having a relatively high potential, which electrodes constitute the main electron lens and substantially oppose, the pair of side beam through holes of the second electrode are decentered outward in the arrangement direction of the three electron beams with respect to the pair of side beam through holes of the first electrode, and each of the pair of side beam through holes of any one of the first and second electrodes is formed to have a substantially horizontally elongated shape in which both sides in the arrangement direction of the three electron beams are constituted by arcs and the length of, in the case of the first electrode, the length of the inner arc is larger than the length of the outer arc while, in the case of the second electrode, the length of the inner arc is smaller than the length of the outer arc. The three electron beams can be properly focused to obtain good image characteristics on an entire screen.

10 Claims, 10 Drawing Sheets

COLOR CATHODE RAY TUBE APPARATUS

BACKGROUND OF THE INVENTION

1. Field of the Invention

The present invention relates to a color cathode ray tube apparatus and, more particularly, to a color cathode ray tube apparatus in which the focus characteristics of an electron gun assembly for emitting three electron beams arranged in a line and passing through the same plane are improved.

2. Description of the Related Art

A color cathode ray tube apparatus generally has the following structure. That is, three electron beams emitted from an electron gun assembly arranged in the neck of an envelope are deflected by horizontal and vertical deflecting magnetic fields generated by a deflection device arranged outside the envelope, and a color image is displayed by horizontally and vertically scanning a phosphor screen. As such a color cathode ray tube apparatus, an in-line type color cathode ray tube apparatus using an electron gun assembly for emitting three electron beams arranged in a line and consisting of a center beam and a pair of side beams which pass through the same horizontal plane is used.

In general, the electron gun assembly of the color cathode ray tube apparatus has an electron beam forming section, which controls electron emission from cathodes, focuses the emitted electrons to form three electron beams and is constituted by the cathodes and a plurality of electrodes sequentially arranged adjacent to each other on the cathodes, and a main electron lens section constituted by a plurality of electrodes for focusing and converging the three electron beams obtained by the electron beam forming section on a phosphor screen.

In the above color cathode ray tube apparatus, in order to make the characteristics of an image drawn on the phosphor screen preferable, the three electron beams emitted from the electron gun assembly must be appropriately focused and converged in the entire area of the phosphor screen.

As a method of converging the three electron beams, for example, as described in U.S. Pat. No. 2,957,106, a method of inclining and emitting the three electron beams from the electron gun assembly is used. In addition, as described in U.S. Pat. No. 3,772,554, a method of converging the three electron beams such that, of the three electron beam through holes of the electrodes constituting the main electron lens section, a pair of side beam through holes are slightly externally decentered from the side beam through holes of the adjacent electrode on the electron beam forming section side is also used. Both the methods are popularly used.

However, even when the electron gun assembly is constituted as described above, in an actual color cathode ray tube apparatus, convergence errors of the three electron beams occur when the electron beams are deflected. For this reason, a color cathode ray tube apparatus having the following structure is used. That is, a pin-cushion-shaped horizontal deflecting magnetic field and a barrel-shaped vertical deflecting magnetic field are generated by the deflection device for deflecting the three electron beams arranged in a line and constituted by the center beam and the pair of side beams passing through the same plane, and the three electron beams arranged in a line are converged in the entire area of the phosphor screen by these ununiform deflecting magnetic fields. This color cathode ray tube apparatus is known as a self-convergence-in-line type color cathode ray tube apparatus, and this color cathode ray tube apparatus is prevalent at present.

However, when the three electron beams are converged by the deflecting magnetic fields generated by the deflection device, the three electron beams considerably receive the influence of deflection errors, and the distortion of a beam spot at the peripheral portion of the screen increases, thereby degrading a resolution. The degradation of the resolution caused by the deflection errors becomes conspicuous when a deflection angle increases from 90° to 110°.

The degradation of the resolution at the peripheral portion of the screen occurs because, of three electron beams 1B, 1G, and 1R arranged in a line and shown in FIGS. 1 and 2, as shown in FIGS. 1 and 2 with respect to the side beam 1R of the pair of side beams, a focus operation is weakened in the horizontal direction (X-axis direction) but strengthened in the vertical direction (Y-axis direction) by a pin-cushion-shaped horizontal deflecting magnetic field 2H and a barrel-shaped vertical deflecting magnetic field 2V. As a result, as shown in FIG. 3, although a circular beam spot 3 is formed at the central portion of the screen, a beam spot 3 at the peripheral portion has a shape obtained by forming low-luminance halo portions 5 at the upper and lower portions of an oval high-luminance portion 4 having a horizontal major axis, and the resolution of the peripheral portion of the screen is considerably degraded.

A technique for reducing the distortion of the beam spot 3 at the peripheral portion of the screen caused by deflection errors to prevent degradation of a resolution is disclosed in Jpn. Pat. Appln. KOKOKU Publication No. 60-7345 (U.S. Pat. No. 4,887,001), Jpn. Pat. Appln. KOKAI Publication No. 64-38947 (U.S. Pat. No. 4,897,575), or Jpn. Pat. Appln. KOKAI Publication No. 1-236554 (U.S. Pat. No. 5,034, 652). In particular, in an electron gun assembly disclosed in Jpn. Pat. Appln. KOKOKU Publication No. 60-7345 or Jpn. Pat. Appln. KOKAI Publication No. 1-236554, a beam spot at the central portion of a screen can be decreased in size. In a color cathode ray tube apparatus disclosed in Jpn. Pat. Appln. KOKAI Publication No. 64-38947, the distortion of a beam spot at the peripheral portion of the screen can be considerably decreased in size by a dynamic focus operation for changing the strength of the electron lenses of an electron gun assembly in accordance with a deflection amount, and an image having a high resolution can be obtained.

As described in these publications, this structure can be obtained such that an electron optical system for forming asymmetrical electron lenses in front of or behind the area of a normal symmetrical cylindrical electron lens is employed. However, in order to form such asymmetrical electron lenses, according to a conventional technique, a flange-like electric-field correction electrode is inserted into a bath-tub electrode, or electron beam through holes each having a horizontal major axis are formed.

As an example of this structure, an electron gun assembly in which an electric-field correction electrode is arranged is shown in FIG. 4. This electron gun assembly has three cathodes KB, KG, and KR arranged in a line, three heaters (not shown) for respectively heating the cathodes KB, KG, and KR, first to fourth grids G1 to G4 sequentially arranged adjacent to the cathodes KB, KG, and KR in the direction of a phosphor screen, and a convergence cup Cp arranged on the fourth grid G4. The cathodes KB, KG, and KR and the first to fourth grids G1 to G4 are assembled to have a structure integrally fixed by a pair of insulating support members (not shown).

In this electron gun assembly, each of the first and second grids G1 and G2 is constituted by a plate-like electrode in which three relatively small electron beam through holes arranged in a line in correspondence with the cathodes KB, KG, and KR are formed. The third grid G3 is constituted by a cylindrical electrode obtained by connecting two bath-tub electrodes G31 and G32 to each other, and the fourth grid G4 is constituted by connecting two bath-tub electrodes G41 and G42 to each other. Three electron beam through holes each having a diameter larger than each of the electron beam through holes of the second grid G2 and arranged in a line in correspondence with the cathodes KB, KG, and KR are formed in the surface of the third grid G3 opposing the second grid G2. Three electron beam through holes 8B, 8G, and 8R each having a diameter larger than each of the electron beam through holes of the surface of the third grid G3 opposing the second grid G2 and arranged in a line in correspondence with the cathodes KB, KG, and KR are formed in the surface of the third grid G3 opposing the fourth grid G4. Three electron beam through holes 9B, 9G, and 9R each having a diameter almost equal to that of each of the electron beam through holes 8B, 8G, and 8R and arranged in a line in correspondence with the cathodes KB, KG, and KR are formed in the surface of the fourth grid G4 opposing the third grid G3. Three electron beam through holes each having a diameter almost equal to that of each of the three electron beam through holes 9B, 9G, and 9R and arranged in a line in correspondence with the cathodes KB, KG, and KR are formed in each of the opposing surfaces of the fourth grid G4 and the convergence cup Cp. In addition, the pair of side beam through holes 9B and 9R in the surface of the fourth grid G4 opposing the third grid G3 are slightly externally decentered from the pair of side beam through holes 8B and 8R in the surface of the third grid G3 opposing the fourth grid G4 in the arrangement direction of these electron beam through holes. A pair of electric-field correction electrodes 10*a* and 10*b* are respectively arranged inside the opposing bath-tub electrodes G32 and G41 of the third and fourth grids G3 and G4 to vertically sandwich the three electron beam through holes 8B, 8G, 8R, 9B, 9G, and 9R.

In this electron gun assembly, a voltage obtained by adding a video signal voltage to a cutoff voltage of 200 V is applied to the cathodes KB, KG, and KR, the potential of the first grid G1 is set to be a ground potential, and a positive high voltage of 500 to 1,000 V, a positive high voltage of 5 to 10 kV, and a positive high voltage of 25 to 30 kV are applied to the second, third and fourth grids G2, G3, and G4, respectively. In this manner, high-performance electron lenses are formed between these electrodes.

Even when the electron gun assembly is constituted as described above, of the three electron beams arranged in a line and emitted from the electron gun assembly, the center beam can be preferably converged, but the pair of side beams are disturbed due to a coma of the electron lens. For this reason, a beam spot at the central portion of the screen is distorted. Moreover, when the beams at the peripheral portions of the screen are deflected, the beams receive more strong deflection errors, and a beam spot at each peripheral portion of the screen is considerably distorted.

Lens components acting on the pair of side beams of a main electron lens section formed between the third and fourth grids G3 and G4 are represented by vectors. For example, as indicated by arrows 11H and 11V in FIG. 5A, a quadrupole lens component for horizontally diverging and vertically focusing the side beam 1R acts on the side beam 1R on the third grid G3 side, and as indicated by arrows 12H1, 12H2, 12V1, and 12V2 in FIG. 5B, a prism component for deflecting the side beam 1R in the direction of the center beam acts between the third and fourth grids G3 and G4. In addition, as indicated by arrows 13H and 13V in FIG. 5C, a non-orthogonal quadrupole lens component for horizontally focusing and vertically diverging the side beam 1R in a direction inclined with respect to the vertical axis (Y-axis) acts on the side beam 1R on the fourth grid G4 side. As shown in FIG. 5D, the side beam 1R is influenced by the vector of a lens component obtained by synthesizing the above lens components except for the prism component. More specifically, as the operations of the synthesized lens component for the side beam 1R, focus vectors 14H having the same length act from both the horizontal sides to the center of the beam, and focus vectors 14V each having a horizontal component deviated from the center beam obliquely act from both the vertical sides. For this reason, the rotationally symmetrical side beam 1R free from distortion as shown in FIG. 6A is focused such that a vertical beam component has an arc-like shape as indicated by a broken line in FIG. 6B. This causes the electron beam to be distorted.

As a means for correcting the distortion of the electron beam, an electron gun assembly in which a correction plate having trapezoidal electron beam through holes is formed in an electrode constituting a main electron lens section is described in the Jpn. Pat. Appln. KOKAI Publication No. 4-267037. However, even when this correction plate is arranged in the electrode, only a weak correction operation is obtained. For this reason, when an electron lens having a non-orthogonal asymmetrical lens component is formed between opposing electrodes, a satisfactory correction effect cannot be obtained.

In addition, an electron gun assembly having the following structure is disclosed in Jpn. Pat. Appln. KOKOKU Publication No. 5-3659. That is, opposing bath-tub electrodes are arranged, and an electrode in which three electron beam through holes are formed is arranged in each of the bath-tub electrodes, thereby correcting the multipolar lens components of an electron lens. In this electron gun assembly, a large-diameter electron lens commonly acting on three electron beams is formed by the opposing bath-tub electrodes, and this large-diameter electron lens becomes an electron lens having asymmetrical lens component having very strong orthogonality with respect to the pair of side beams. Therefore, in order to correct the asymmetrical lens component, each of the electron beam through holes of the electrode arranged in each bath-tub electrode has a polygonal shape. However, this electron gun assembly has a weak correction operation because the electrode is arranged in each bath-tub electrode. In addition, when the electrodes are arranged to be close to the opposing surfaces of the bath-tub electrodes to strengthen the correction operation, the effective diameter of the large-diameter electron lens decreases, i.e., a structural dilemma occurs. For this reason, a design for the electron gun assembly is limited.

In a picture tube, electron beams are not always focused in an optimal state on a phosphor screen due to variations in applied voltage or assembling of an electron gun assembly. For this reason, in general, a focus voltage is made variable, and the focus voltage is adjusted to obtain an optimal beam spot. However, in each of the above examples, a correction electrode is arranged between the opposing electrodes, and an electric-field permeated into the correction electrode is uniformed to correct the distortion of an electron beam. For this reason, when an optimal focus voltage is different from an optimal electron beam distortion correction voltage, a distortion correction operation for the electron beam becomes improper, and an optimal beam spot cannot be obtained.

As described above, in a self-convergence-in-line type color cathode ray tube apparatus which has an electron gun assembly for emitting three electron beams arranged in a line and constituted by a center beam and a pair of side beam passing through the same plane and which converges the three electron beams emitted from the electron gun assembly in the entire area of a phosphor screen by a deflecting magnetic field generated by a deflection device, the distortion of a beam spot at the peripheral portion of the screen increases due to deflection errors, thereby degrading a resolution. This degradation of the resolution becomes conspicuous when a deflection angle increases. In order to reduce the degradation of the resolution, electron lenses each having an asymmetrical electron lens component are advantageously formed in front or behind the lens area of a normal symmetrical cylindrical electron lens formed at the main electron lens section of the electron gun assembly. Therefore, an electron gun assembly in which degradation of the resolution is reduced by the above conventional method has been developed.

However, in the conventional electron gun assembly for reducing the degradation of the resolution, although the center beam of the three electron beams arranged in a line can be preferably focused, a non-orthogonal asymmetrical lens component acts on the pair of side beams, and the pair of side beams are distorted by a lens aberration. A beam spot is distorted at the central portion of the screen. In addition, when the beams at the peripheral portion of the screen are deflected, the beams receive more strong deflection errors, and a beam spot at the peripheral portion of the screen is considerably distorted, thereby degrading the resolution.

Although an electron gun assembly for correcting a non-orthogonal asymmetrical lens component with respect to a pair of side beams is conventionally developed, since this conventional electron gun assembly for correcting the non-orthogonal asymmetrical lens component locally uniforms part of an electric field permeated into electrodes for forming a main electron lens section, the conventional electron gun assembly does not have a sufficient sensitivity to correct the non-orthogonal asymmetrical lens component of an orthogonal asymmetrical electron lens system, thereby unsatisfactorily correcting the non-orthogonal asymmetrical lens component.

SUMMARY OF THE INVENTION

It is an object of the present invention to constitute a color cathode ray tube apparatus for optimizing a lens aberration received by a pair of side beams to preferably focus three electron beams arranged in a line and passing through the same plane, thereby obtaining preferable image characteristics over an entire screen.

In a color cathode ray tube apparatus which includes an electron gun assembly having a main electron lens section constituted by a plurality of electrodes for focusing and converging three electron beams arranged in a line and constituted by a center beam and a pair of side beams passing through the same plane on a phosphor screen and deflects the three electron beams arranged in a line and emitted from the electron gun assembly by magnetic fields generated by a deflection device to horizontally and vertically scan the phosphor screen, the main electron lens section has at least a first electrode having a relatively low potential and a second electrode having a relatively high potential, which electrodes substantially oppose; three electron beam through holes arranged in a line in an arrangement direction of the three electron beams and constituted by a center beam through hole and a pair of side beams are formed in each of the opposing surfaces of the first and second electrodes; of the three electron beam through holes in each of the first and second electrodes, the pair of side beam through holes of the second electrode are off-centered outward in the arrangement direction of the three electron beams with respect to the pair of side beam through holes of the first electrode; and each of the pair of side beam through holes of any one of the first and second electrodes is formed to have a substantially horizontally elongated shape in which both sides in the arrangement direction of the three electron beams are constituted by arcs and the lengths of the inner and outer arcs in the arrangement direction of the three electron beams are different from each other.

In addition, each of the pair of side beam through holes of the first electrode is formed to have a substantially horizontally elongated shape, the length of the inner arc of each side beam through hole in the arrangement direction of the three electron beams is larger than that of the outer arc, and an electron lens having a quadrupole lens component for vertically focusing the pair of side beams is formed between the first and second electrodes.

Each of the pair of side beam through holes of the second electrode is formed to have a substantially horizontally elongated shape, the length of the inner arc of each side beam through hole in the arrangement direction of the three electron beams is smaller than that of the outer arc, and an electron lens having a quadrupole lens component for vertically diverging the pair of side beams is formed between the first and second electrodes.

As described above, each of the pair of side beam through holes of any one of the first electrode having a relatively low potential and the second electrode having a relatively high potential, which electrodes substantially oppose and constitute the main electron lens section, is formed to have a substantially horizontally elongated shape in which both sides in the arrangement direction of the three electron beams are constituted by arcs and, in the case of the first electrode, the length of the inner arc is larger than the length of the outer arc while, in the case of the second electrode, the length of the inner arc is smaller than the length of the outer arc. In this case, an electric field permeated between the first and second electrodes and into these electrodes are uniformed to form an orthogonal asymmetrical electron lens for canceling a non-orthogonal asymmetrical electron lens component, thereby improving the orthogonality of an electron lens obtained by synthesizing these lens components. In addition, an asymmetrical lens component having a very small non-orthogonal electron lens component can be formed. As a result, an asymmetrical electron lens having a small non-orthogonal lens component and excellent orthogonality can be formed, and the three electron beams arranged in a line can be preferably focused on the phosphor screen, thereby obtaining good image characteristics of the entire screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A color cathode ray tube apparatus according to the present invention will be described below on the basis of embodiments with reference to the accompanying drawings.

First Embodiment

Figure 1:
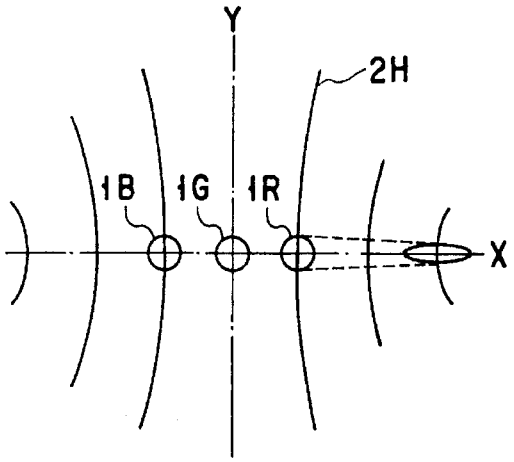
FIG. 1 is a view for explaining the operation of a pin-cushion-shaped horizontal deflection magnetic field with respect to electron beams in a conventional color cathode ray tube apparatus.
Figure 2:
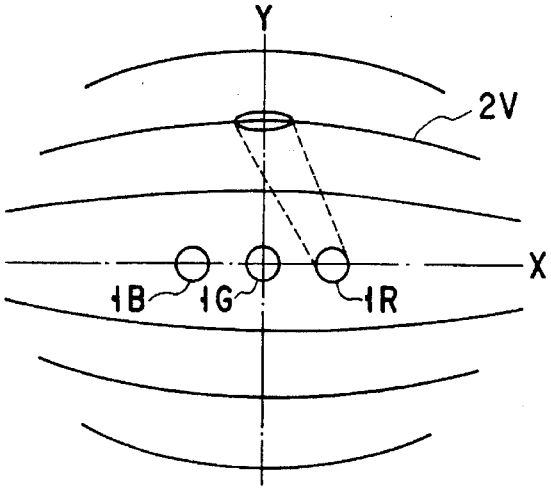
FIG. 2 is a view for explaining the operation of the barrel-shaped vertical deflection magnetic field in a conventional color cathode ray tube apparatus.
Figure 3:
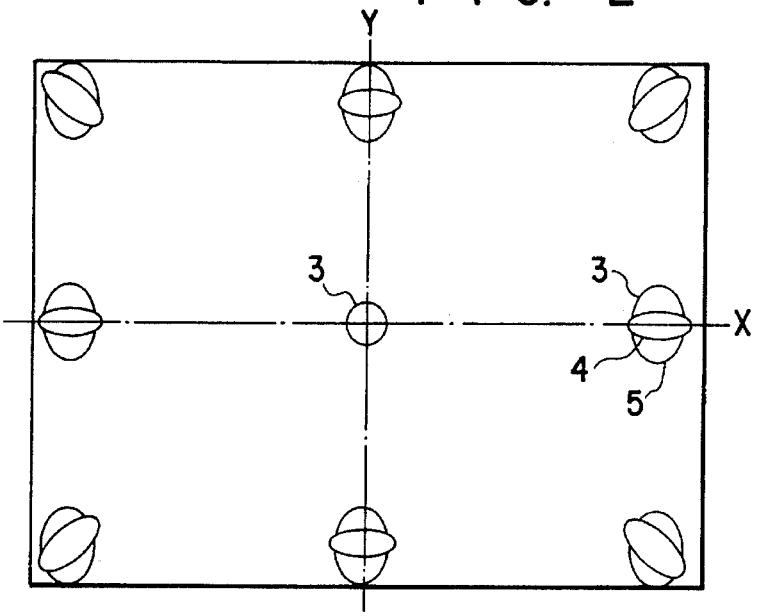
FIG. 3 is a view for explaining the shapes of beam spots of electron beams deflected by the pin-cushion-shaped horizontal deflection magnetic field and barrel-shaped vertical deflection magnetic field in the conventional color cathode ray tube apparatus.
Figure 4:
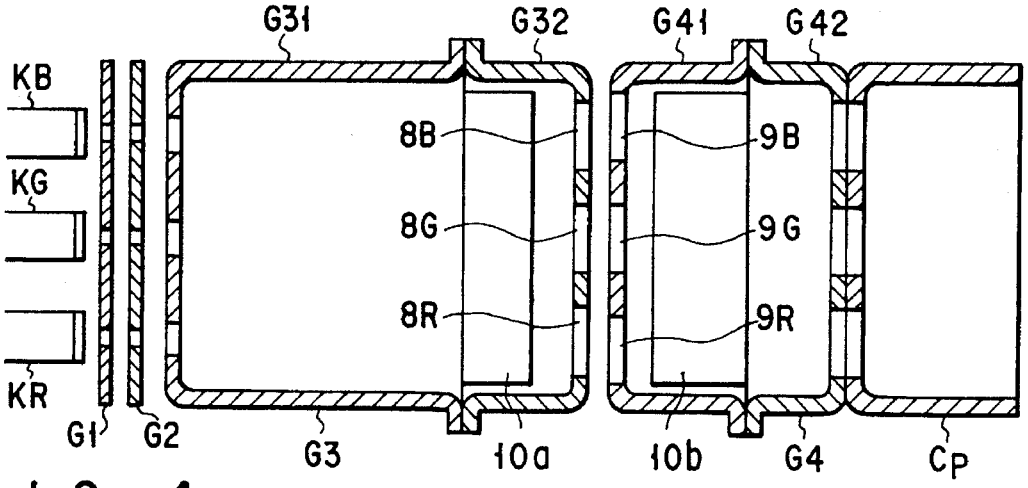
FIG. 4 is a horizontal sectional view showing the arrangement of an electron gun assembly of the conventional color cathode ray tube apparatus.
Figure 5A:
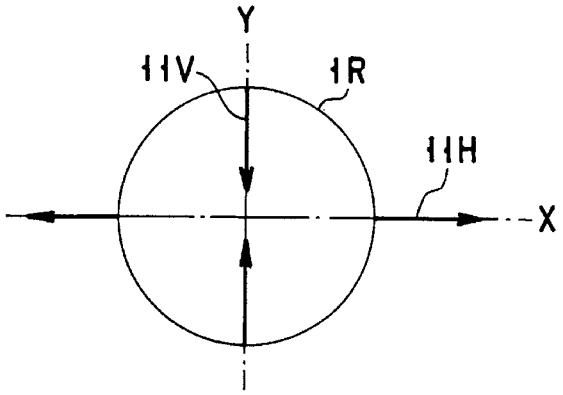
FIGS. 5A, 5B, 5C, and 5D are views for respectively explaining the operations of the lens components of electron lenses formed between the third and fourth grids of the electron gun assembly in FIG. 4 with respect to a side beam.
Figure 5C:
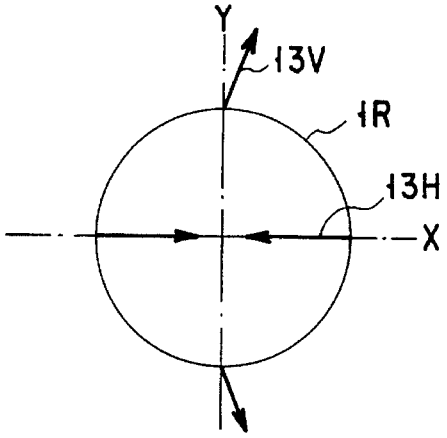
Figure 5B:
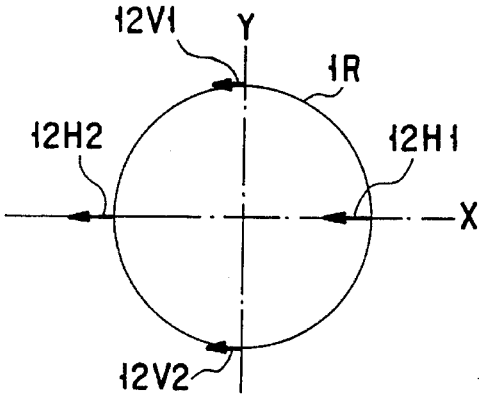
Figure 5D:
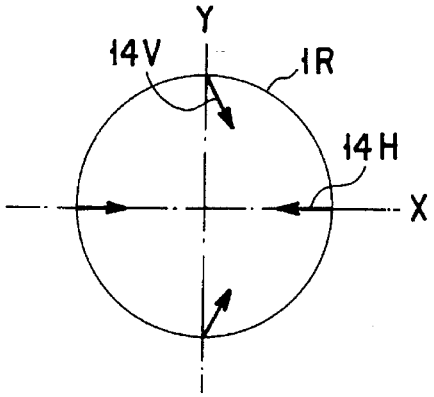
Figure 6A:
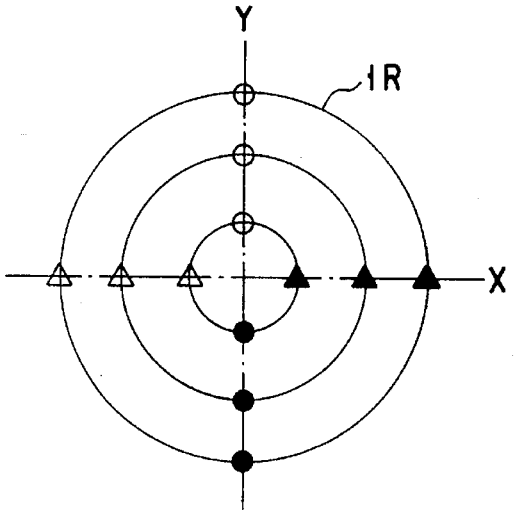
FIGS. 6A and 6B are views for respectively explaining the shapes of beam spots formed on a phosphor screen by the electron lenses formed between the third and fourth grids of the electron gun assembly.
Figure 6B:
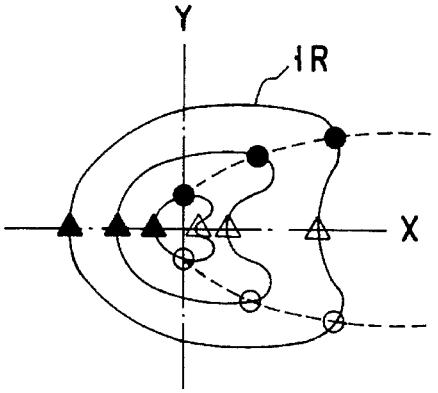
Figure 7:
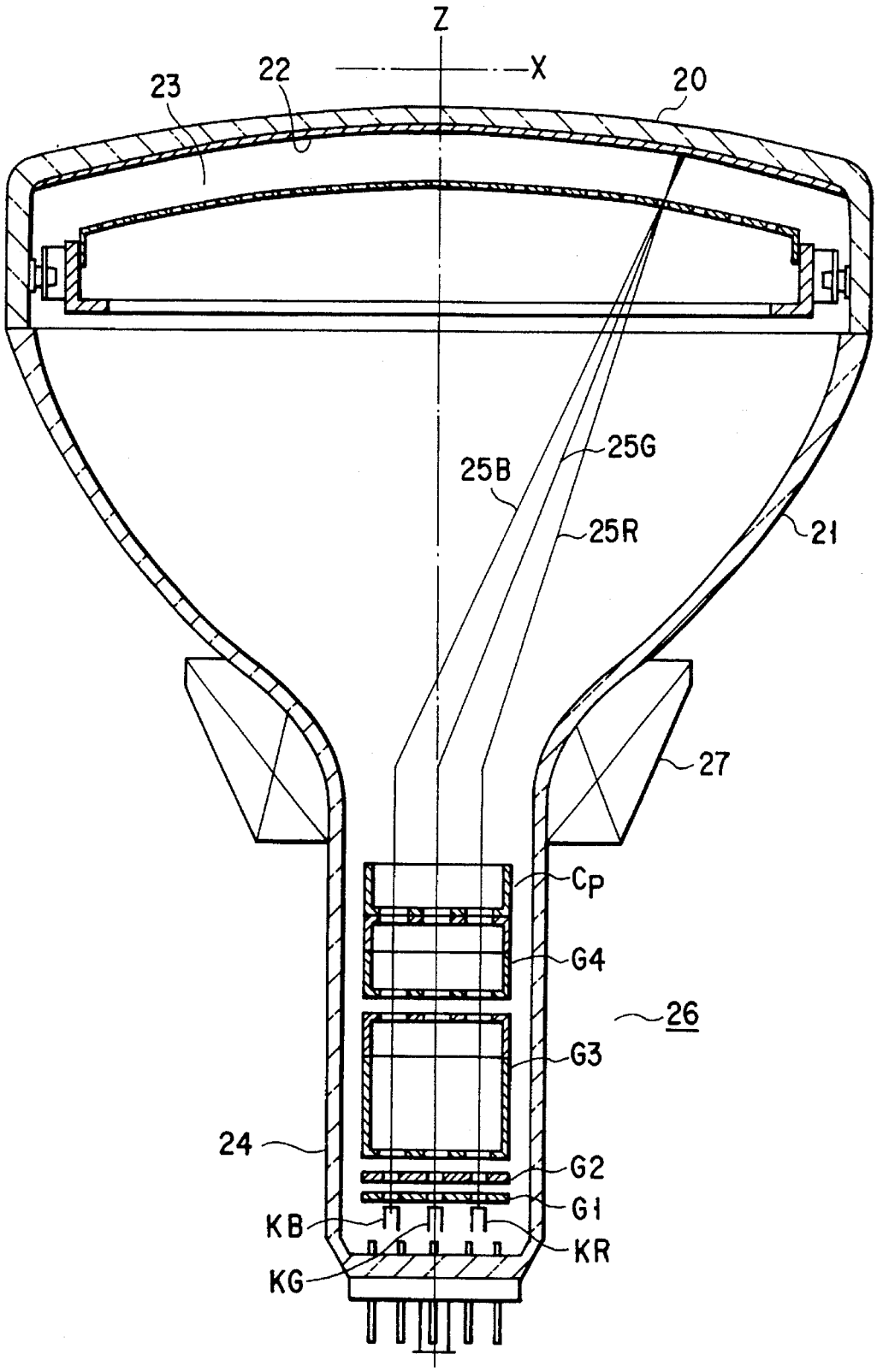
FIG. 7 is a view showing a color cathode ray tube apparatus according to the first embodiment of the present invention.

FIG. 7 shows a color cathode ray tube apparatus according to the first embodiment of the present invention. This color cathode ray tube apparatus has an envelope constituted by a panel 20 and a funnel 21 integrally connected to the panel 20. A phosphor screen 22 constituted by stripe-like three-color phosphor layers for emitting blue, green, and red beams is formed on the inner surface of the panel 20, and a shadow mask 23 in which a large number of electron beam through holes are formed is arranged inside the phosphor screen 22 to oppose the phosphor screen 22. On the other hand, an electron gun assembly 26 for emitting three electron beams 25B, 25G, and 25R arranged in a line and constituted by a center beam 25G and a pair of side beams 25B and 25R passing through the same horizontal plane is arranged in a neck 24 of the funnel 21. The three electron beams 25B, 25G, and 25R emitted from the electron gun assembly 26 are deflected by magnetic fields generated by a deflection device 27 arranged outside the funnel 21 to horizontally and vertically scan the phosphor screen, thereby displaying a color image.

Figure 8A:
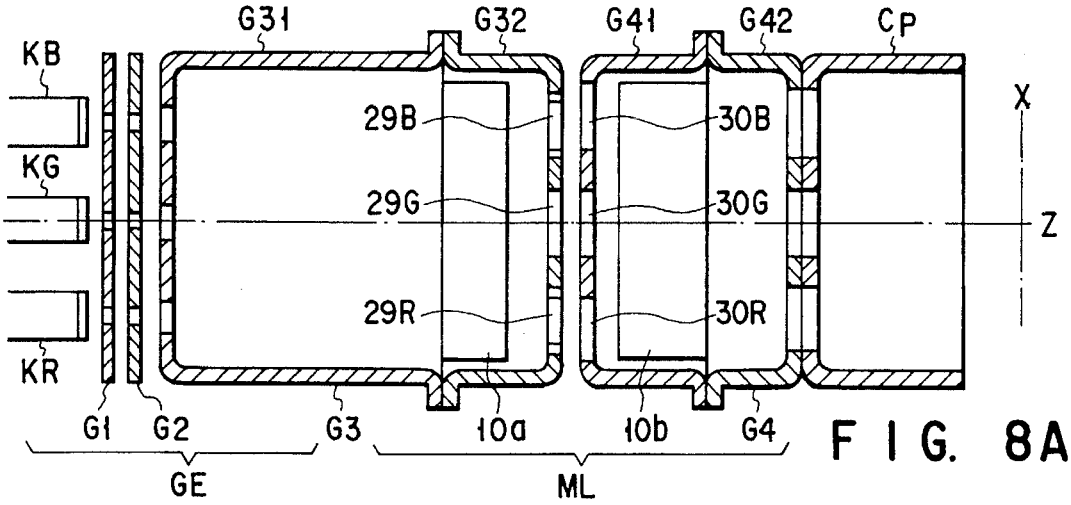
FIGS. 8A and 8B are horizontal and vertical sectional views, respectively, showing the color cathode ray tube apparatus shown in FIG. 7.
Figure 8B:
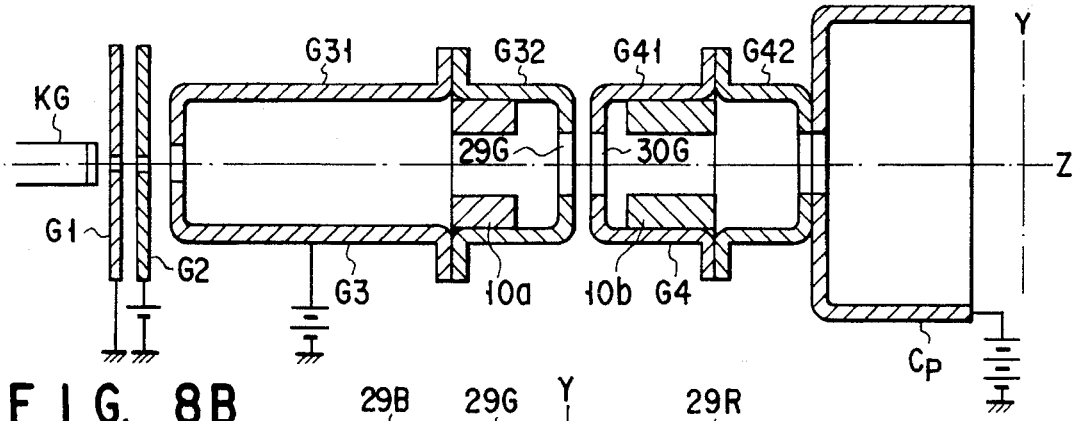

The above electron gun assembly 26, as shown in FIGS. 8A and 8B, has three cathodes KB, KG, and KR arranged in a line in the horizontal direction (X-axis direction), three heaters (not shown) for respectively heating the cathodes KB, KG, and KR, first to fourth grids G1 to G4 which are sequentially arranged at a predetermined interval in the direction of the phosphor screen and which are adjacent to the cathodes KB, KG, and KR, and a convergence cup Cp arranged on the fourth grid G4. The heaters, the cathodes KB, KG, and KR, and the first to fourth grids G1 to G4 are integrally fixed by a pair of insulating support members (not shown).

Figure 9A:
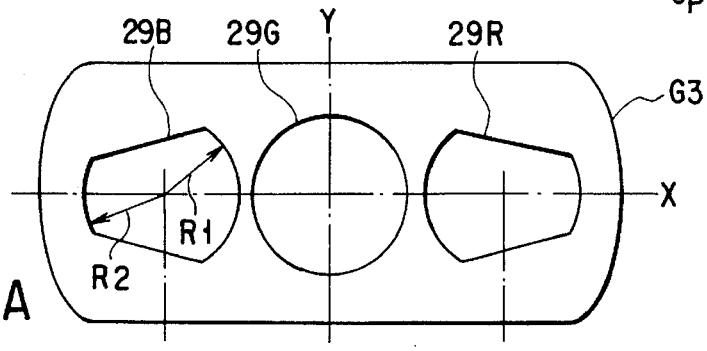
FIGS. 9A and 9B are plan views respectively showing the electron beam through holes of the third and fourth grids of the electron gun assembly shown in FIGS. 8A and 8B.

Each of the first and second grids G1 and G2 is constituted by a plate-like electrode in which three circular electron beam through holes each having a relatively small diameter and arranged in a line in the arrangement direction (horizontal direction) of the three electron beams in correspondence with the cathodes KB, KG, and KR. The third grid G3 is constituted by a cylindrical electrode obtained by connecting two bath-tub electrodes G31 and G32 to each other, and the fourth grid G4 is constituted by a cylindrical electrode obtained by connecting two bath-tub electrodes G41 and G42 to each other. Three circular electron beam through holes each having a diameter larger than that of each of the electron beam through holes of the second grid G2 arranged in a line in the arrangement direction of the three electron beams are formed in the surface of the third grid G3 opposing the second grid G2. As shown in FIG. 9A, the three electron beam through holes 29B, 29G, and 29R arranged in a line in the arrangement direction of the three electron beams are formed in the surface of the fourth grid opposing the third grid G3. Inside the bath-tub electrode G32 in which the electron beam through holes 29B, 29G, and 29R are formed, as shown in FIG. 8B, a pair of electric-field correction electrodes 10*a* are arranged to sandwich the three electron beam through holes 29B, 29G, and 29R from the vertical direction (Y-axis direction). Three circular electron beam through holes 30B, 30G, and 30R (to be described later) arranged in a line in the arrangement direction of the three electron beams are formed in the surface of the fourth grid G4 opposing the third grid G3. Inside the bath-tub electrode G41 in which the electron beam through holes 30B, 30G, and 30R are formed, as shown in FIG. 8B, a pair of electric-field correction electrodes 10*b* are arranged to sandwich the electron beam through holes 30B, 30G, and 30R from the vertical direction. Three circular electron beam through holes each having a diameter almost equal to that of each of the electron beam through holes 30B, 30G, and 30R in the surface of the third grid G3 opposing the fourth grid G4 and arranged in a line in the arrangement direction of the three electron beams are formed in each of the opposing surfaces of the fourth grid G4 and the convergence cup Cp.

Of the electron beam through holes 29B, 29G, and 29R formed in the surface of the third grid G3 opposing the fourth grid G4, as shown in FIG. 9A, the center beam through hole 29G is formed to have a circular shape having a diameter larger than that of each of the circular electron beam through holes formed in the surface of the third grid G3 opposing the second grid G2. However, each of the pair of side beam through holes 29B and 29R is formed to have a horizontally elongated shape in which both sides in the arrangement direction of the three electron beams are constituted by arcs respectively having radii R1 and R2 and these arcs are connected to each other with straight lines. The length of the inner arc on the center beam through hole 29G side is larger than that of the outer arc. Note that the radii R1 and R2 of the arcs may satisfy the following equation:

$$R1=R2$$

or the radius R1 of the inner arc on the center beam through hole 29G side may be set to be larger than the radius R2 of the outer arc, i.e., the following condition may be satisfied:

$$R1>R2$$

Figure 9B:
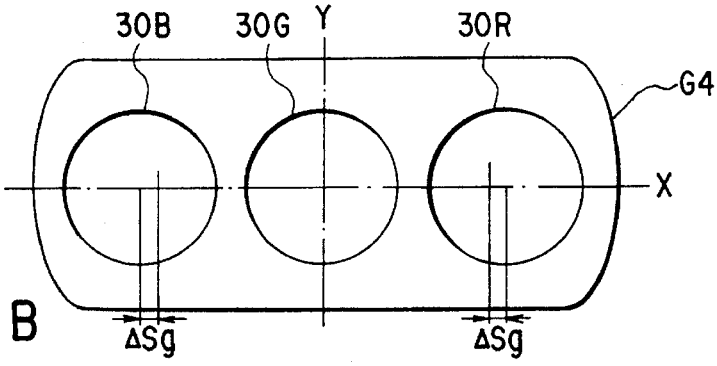

Although the electron beam through holes 29B, 29G, and 29R of the third grid G3 are formed as described above, each of the electron beam through holes 30B, 30G, and 30R in the surface of the fourth grid G4 opposing the third grid G3, as shown in FIG. 9B, is formed to have a circular shape having a diameter almost equal to that of the center beam through hole 29G of the third grid G3. In addition, of the electron beam through holes 30B, 30G, and 30R of the fourth grid G4, the pair of side beam through holes 30B and 30R are slightly off-centered outward in the arrangement direction of the three electron beams by ΔSg with respect to the pair of side beam through holes 29B and 29R in the surface of the third grid G3 opposing the fourth grid G4.

In this electron gun assembly 26, for example, a voltage obtained by adding a video signal voltage to a cutoff voltage of 200 V is applied to the cathodes KB, KG, and KR, the first grid G1 is set to be a ground potential, and a positive high voltage of 500 to 1,000 V, a positive high voltage of 5 to 10 kV, and a positive high voltage of 25 to 30 kV are applied to the second, third and fourth grids G2, G3, and G4, respectively.

In this manner, an electron beam forming section GE which controls electron emission from the cathodes KB, KG, and KR and focuses the emitted electrons to form three electron beams arranged in a line is formed by the cathodes KB, KG, and KR and the first and second grids G1 and G2 sequentially adjacent to the cathodes KB, KG, and KR and focusing the emitted electrons. In addition, a main lens section ML for focusing and converging three electron beams obtained from the electron beam forming section GE on a phosphor screen is formed by the third and fourth grids G3 and G4 therebetween.

Figure 10A:
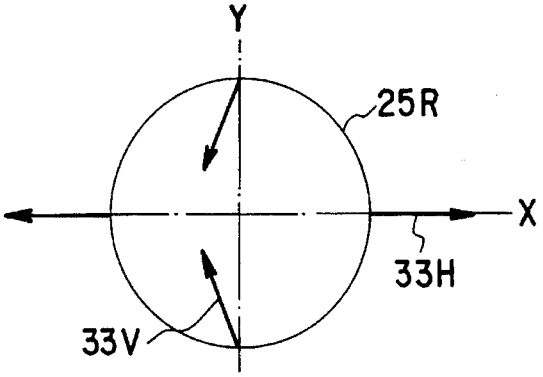
FIGS. 10A, 10B, 10C, and 10D are views respectively showing the operations of the lens components of the electron lenses formed between the third and fourth grids of the electron gun assembly shown in FIGS. 8A and 8B.
Figure 10C:
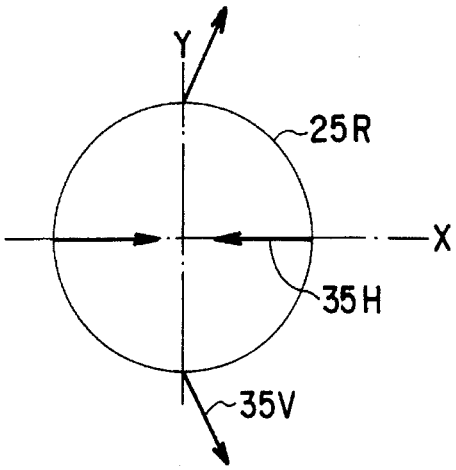
Figure 10B:
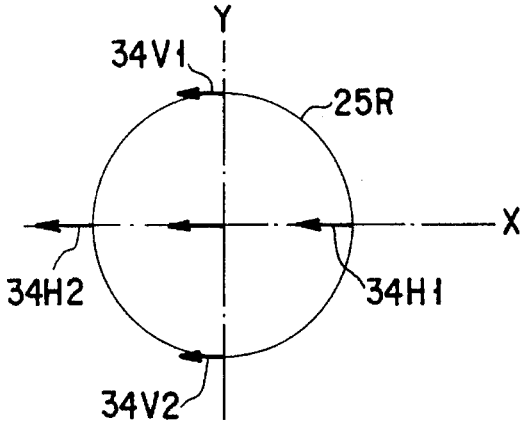

At the main electron lens section ML of the electron gun assembly, as described above, the pair of side beam through holes 29B and 29R each having a horizontally elongated shape in which both sides in the arrangement direction of the three electron beams are constituted by arcs are formed in the surface of the third grid G3 opposing the fourth grid G4, and, in correspondence with the pair of side beam through holes 29B and 29R, the pair of side beam through holes 30B and 30R decentered outward by ΔSg in the arrangement direction of the three electron beams are formed in the surface of the fourth grid G4 opposing the third grid G3. For this reason, as shown in FIG. 10A with respect to the side beam 25R, a non-orthogonal quadrupole lens component having a horizontal divergence operation indicated by an arrow 33H and a vertical focus operation indicated by an arrow 33V having a component having a direction to cause the side beam 25R to be close to the center beam acts on the third grid side, as indicated by arrows 34H1, 34H2, 34V1, and 34V2 in FIG. 10B, to obtain a prism operation for deflecting the side beam 25R in a direction to cause the side beam 25R to be close to the center beam. On the other hand, as shown in FIG. 10C, a non-orthogonal quadrupole lens component having a horizontal focus operation indicated by an arrow 35H and a vertical divergence operation indicated by an arrow 35V and having a component in a direction to cause the side beam 25R to be away from the center beam acts on the fourth grid side.

Figure 10D:
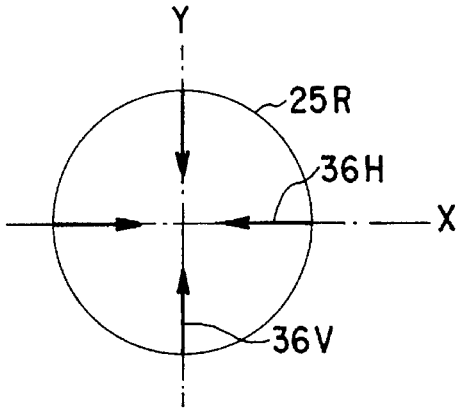
Figure 11A:
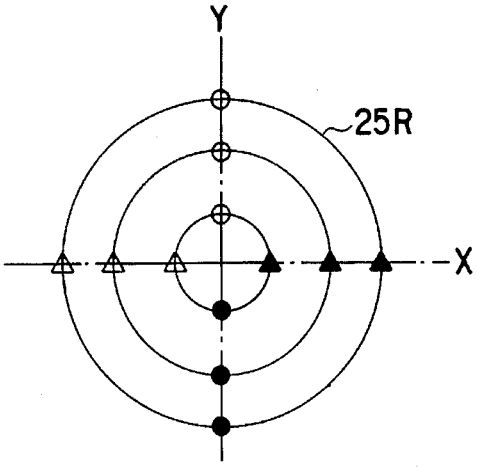
FIGS. 11A and 11B are views for respectively explaining the shapes of beam spots on a phosphor screen formed by the electron lenses formed between the third and fourth grids of the electron gun assembly shown in FIGS. 8A and 8B.
Figure 11B:
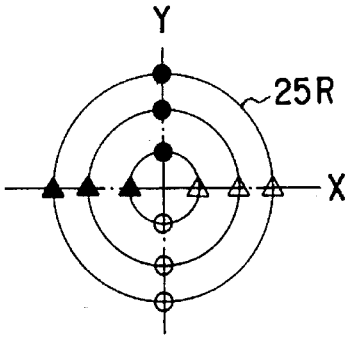

Since the horizontal components of the vectors indicated by the non-orthogonal arrows 33V and 35V on the horizontal axis have different directions, the horizontal components cancel out. As a result, as shown in FIG. 10D, since a focus operation indicated by orthogonal arrows 36H and 36V and acting in the direction of the central portion of the side beam 25R acts on the side beam 25R by the lens operation obtained by synthesizing the lens components except for the prism component, the rotationally symmetrical side beam 25R free from distortion and shown in FIG. 11A can be focused and converged on the phosphor screen to have the rotationally symmetrical shape free from distortion as shown in FIG. 11B. Similarly, the side beam 25B can be focused and converged on the phosphor screen to have a rotationally symmetrical shape free from distortion.

Therefore, when the electron gun assembly 26 is constituted as described above, the three beams 25B, 25G, and 25R arranged in a line and passing through the same horizontal plane can be preferably focused, and a color cathode ray tube apparatus capable of obtaining preferable image characteristics over the entire screen can be obtained.

Second Embodiment

The color cathode ray tube apparatus in which the pair of side beam through holes each having the horizontally elongated shape in which both the sides in the arrangement direction of the three electron beams are constituted by arcs are formed in the surface of the third grid G3 opposing the fourth grid G4, which grids form the main lens section of the electron gun assembly, is described in the first embodiment. An electron gun assembly, like the electron gun assembly shown in FIGS. 8A and 8B, is constituted by a structure having three cathodes horizontally arranged in a line, three heaters for respectively heating these cathodes, first to fourth grids sequentially arranged in the direction of a phosphor screen and adjacent to the cathodes, and a convergence cup arranged on the fourth grid, and voltages respectively identical to the voltages applied in the electron gun assembly in the first embodiment are applied to the above electrodes. Even when the third and fourth grids for forming the main electron lens section are formed as shown in FIGS. 12A and 12B, a color cathode ray tube apparatus having the same effect as described in the first embodiment can be obtained.

Figure 12A:
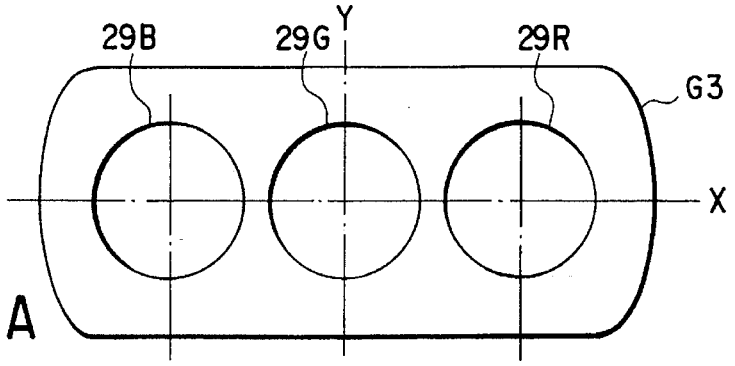
FIGS. 12A and 12B are plan views respectively showing the shapes of electron beam through holes of the third and fourth grids of an electron gun assembly in a color cathode ray tube apparatus according to the second embodiment of the present invention.
Figure 12B:
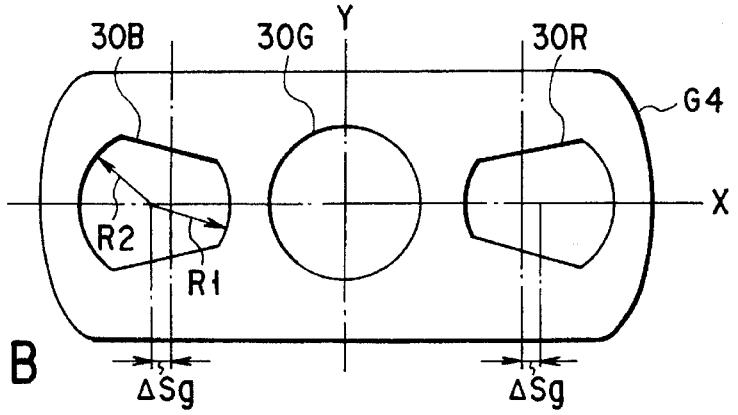

More specifically, as shown in FIG. 12A, electron beam through holes 29B, 29G, and 29R in the surface of a third grid G3 opposing a fourth grid G4 are formed to have circular shapes each having a diameter of each of the electron beam through holes in the surface of the third grid G3 opposing a second grid 62. In contrast to this, as shown in FIG. 12B, are electron beam through holes 30B, 30G, and 30R in the surface of the fourth grid G4 opposing the third grid G3. The center beam through hole 30G is formed to have a circular shape having a diameter equal to that of the center beam through hole 29G in the surface of the third grid G3 opposing the fourth grid G4, and each of the pair of side beam through holes 30B and 30R is formed to have a horizontally elongated shape in which both sides in the arrangement direction of the three electron beams are constituted by arcs respectively having radii R1 and R2 and these arcs are connected to each other with straight lines. In addition, the length of the inner arc on the center beam through hole 30G side is smaller than that of the outer arc. Note that the radii R1 and R2 of the arcs of each of the pair of side beam through holes 30B and 30R may satisfy the following equation:

$$R1=R2$$

as described above. The radius R1 of the inner arc on the center beam through hole 30G side may be set to be smaller than the radius R2 of the outer arc, i.e., the following condition may be satisfied:

$$R1<R2.$$

In addition, of the electron beam through holes 30B, 30G, and 30R of the fourth grid G4, the pair of side beam through holes 30B and 30R are slightly decentered outward in the arrangement direction of the three electron beams by $\Delta Sg$ with respect to the pair of side beam through holes 29B and 29R in the surface of the third grid G3 opposing the fourth grid G4.

Figure 13A:
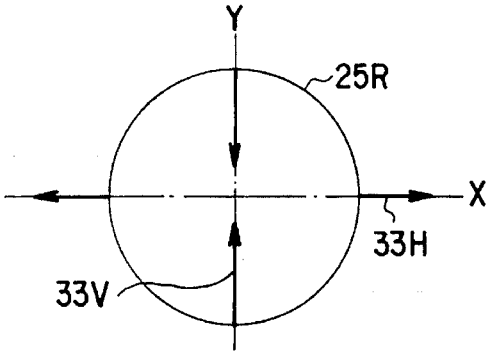
FIGS. 13A, 13B, 13C, and 13D are views for respectively explaining the operations of the electron lenses formed between the third and fourth grids of the electron gun assembly shown in FIGS. 12A and 12B with respect to a side beam.
Figure 13C:
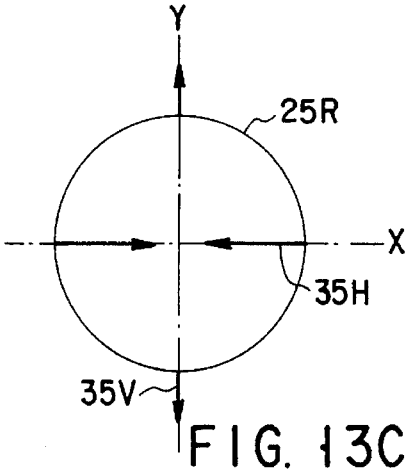
Figure 13B:
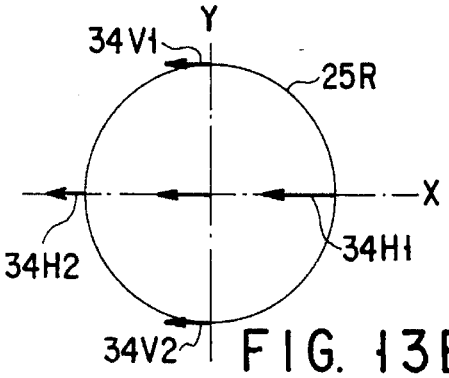

When the electron beam through holes 29B, 29G, 29R 30B, 30G, and 30R of the third and fourth grids G3 and G4 for forming the main electron lens section are formed, as shown in FIG. 13A with respect to the side beam 25R, an orthogonal quadrupole lens component having a horizontal divergence operation indicated by an arrow 33H and a vertical focus operation indicated by an arrow 33V acts on the third grid side, as indicated by arrows 34H1, 34H2, 34V1, and 34V2 in FIG. 13B, to cause a prism operation for deflecting the side beam 25R in a direction to cause the side beam 25R to be close to the center beam. On the fourth grid side, the lens component having the focus operation and the divergence operation which are not perpendicular to each other acts according to a conventional technique. However, according to this embodiment, as shown in FIG. 13C, an orthogonal quadrupole lens component having a horizontal focus operation indicated by the arrow 35H and a vertical divergence operation indicated by the arrow 35V may operate.

Figure 13D:
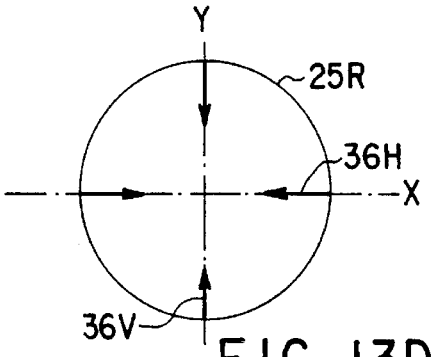
Figure 14A:
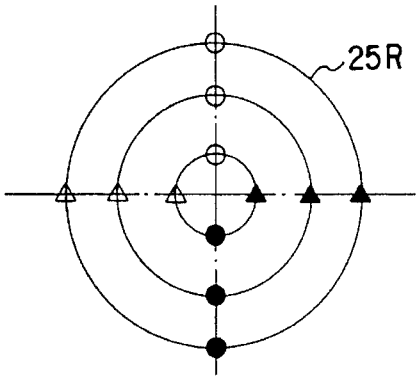
FIGS. 14A and 14B are views for respectively explaining the shapes of beam spots formed on a phosphor screen by an electron lens formed between the third and fourth grids of the electron gun assembly shown in FIGS. 12A and 12B.
Figure 14B:
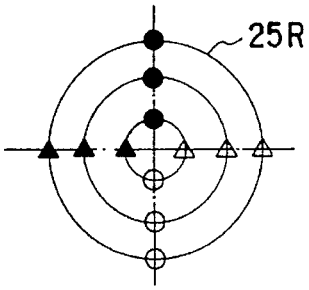

As a result, a lens operation obtained by synthesizing the lens components except for the prism operation acts on the side beam 25R, and as shown in FIG. 13D, a focus operation obtained by causing a lens component 36V acting in the vertical direction of the side beam 25R and a lens component 36H acting in the horizontal direction of the side beam 25R to be perpendicular to each other is performed. Therefore, as shown in FIG. 14A, a rotationally symmetrical side beam 25R free from distortion can be focused and converged on a phosphor screen to have a rotationally symmetrical shape free from distortion as shown in FIG. 14B. Similarly, the side beam 25B can be focused and converged on the phosphor screen to have a rotationally symmetrical shape free from distortion.

Therefore, when the electron gun assembly is constituted as described above, the three beams arranged in a line and passing through the same horizontal plane can be preferably focused, and a color cathode ray tube apparatus capable of obtaining good image characteristics over the entire screen can be obtained.

Third Embodiment

As the third embodiment, a color cathode ray tube apparatus having an electron gun assembly for forming a diffused electric-field type electron lens will be described below.

Figure 15A:
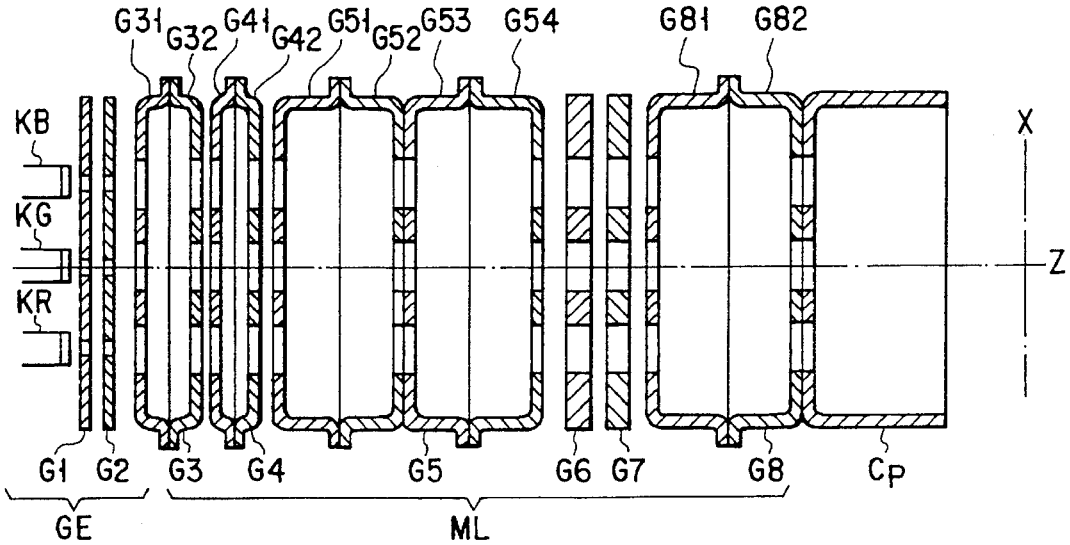
FIGS. 15A and 15B are horizontal and vertical sectional views, respectively, showing an electron gun assembly in a color cathode ray tube apparatus according to the third embodiment of the present invention.
Figure 15B:
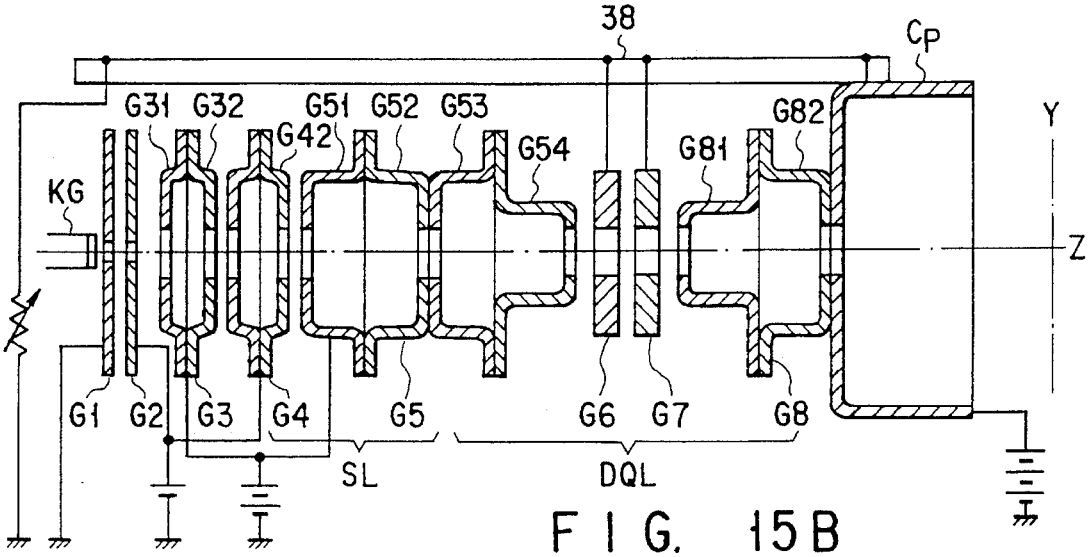

The electron gun assembly of the color cathode ray tube apparatus, as shown in FIGS. 15A and 15B, has three cathodes KB, KG, and KR horizontally arranged in a line, heaters (not shown) for respectively heating the cathodes KB, KG, and KR, first to eighth grids G1 to G8 which are sequentially arranged at a predetermined interval in the direction of a phosphor screen and which are adjacent to the cathodes KB, KG, and KR, and a convergence cup Cp arranged on the eighth grid G8. The heaters, the cathodes KB, KG, and KR, and the first to eighth grids G1 to G8 are integrally fixed by a pair of insulating support members (not shown). Note that, as shown in FIG. 15B, a resistor 38 for dividing a positive high voltage into predetermined voltages to apply them to predetermined electrodes is arranged on one side of the electron gun assembly.

Each of the first and second grids G1 and G2 is constituted by a relatively thin plate-like electrode in which three circular electron beam through holes each having a relatively small diameter horizontally arranged in a line are formed in correspondence with the three cathodes KB, KG, and KR.

Figure 16A:
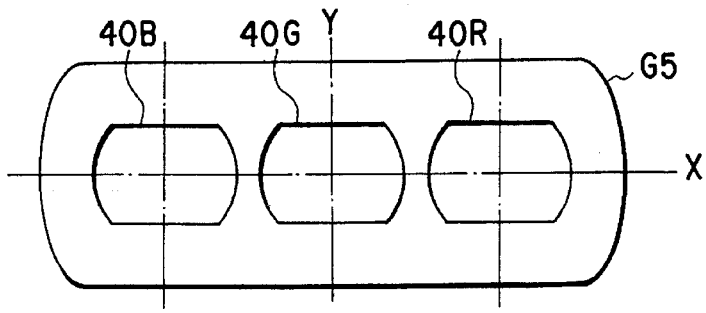
FIGS. 16A, 16B, 16C, and 16D are plan views showing the shapes of the electron beam through holes of the fifth grid of the electron gun assembly shown in FIGS. 15A and 15B, the shapes of the electron beam through holes of the sixth grid, the shapes of the electron beam through holes of the seventh grid, and the shapes of the electron beam through holes of the seventh grid, respectively.

Each of the third, fourth, and fifth grids G3, G4, and G5 is constituted by a cylindrical electrode obtained by connecting a plurality of bath-tub electrodes to each other. More specifically, the third grid G3 is constituted by a cylindrical electrode obtained by connecting two bath-tub electrodes G31 and G32 to each other, the fourth grid G4 is constituted by a cylindrical electrode obtained by connecting two bath-tub electrodes G41 and G42 to each other, and the fifth grid G5 is constituted by a cylindrical electrode obtained by connecting four bath-tub electrodes G51, G52, G53, and G54 to each other. Three circular beam through holes arranged in a line in the arrangement direction of the three electron beams and each having a diameter larger than that of each of the electron beam through holes of the second grid G2 are formed in the surface of the third grid G3 opposing the second grid G2 in correspondence with the three cathodes KB, KG, and KR. Three circular beam through holes arranged in a line in the arrangement direction of the three electron beams and each having a diameter larger than that of each of the electron beam through holes in the second grid G2 are in each of the surface of the third grid G3 opposing the second grid G2, the surface of the third grid G3 opposing the fourth grid G4, the surface of the fourth grid G4 opposing the third grid G3, the surface of the fourth grid G4 opposing the fifth grid G5, and the surface of the fifth grid G5 opposing the fourth grid G4. In the surface of the fifth grid G5 opposing the sixth grid G6, as shown in FIG. 16A, three electron beam through holes 40B, 40G, and 40R arranged in a line in the arrangement direction of the three electron beams and each having an almost rectangular shape having a horizontal long side are formed in correspondence with the three cathodes.

Figure 16B:
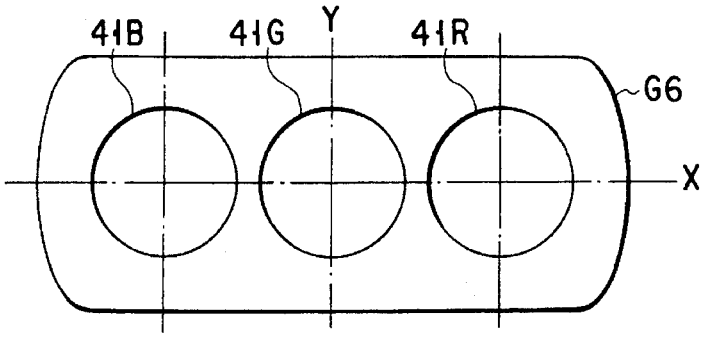
Figure 16C:
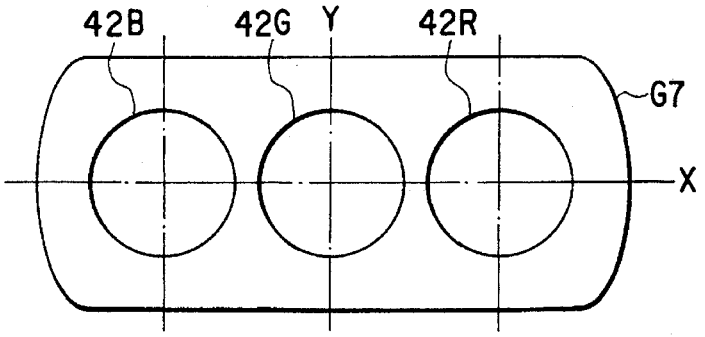

Each of the sixth and seventh grids G6 and G7 is constituted by a relatively thick plate-like electrode. In the sixth grid G6, as shown in FIG. 16B, three circular electron beam through holes 41B, 41G, and 41R arranged in a line in the arrangement direction of the three electron beams and each having a diameter almost equal to the length of the long side of each of the electron beam through holes in the surface of the fifth grid G5 opposing the sixth grid G6. In the seventh grid G7, as shown in FIG. 16C, three circular electron beam through holes 42B, 42G, and 42R arranged in a line in the arrangement direction of the three electron beams and each having a diameter almost equal to that of each of the electron beam through holes of the sixth grid are formed in correspondence with the three cathodes.

Figure 16D:
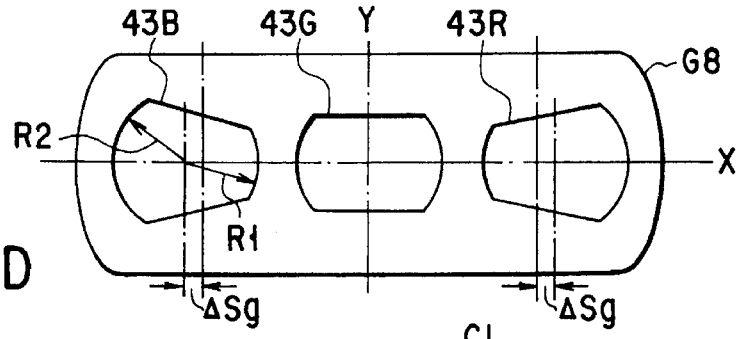

The eighth grid G8 is constituted by a cylindrical electrode obtained by connecting two bath-tub electrodes G81 and G82 to each other, and three electron beam through holes arranged in a line in the arrangement direction of the three electron beams are formed in the surface of the eighth grid G8 opposing the seventh grid G7 in correspondence with the cathodes KB, KG, and KR. Of the three electron beam through holes, as shown in FIG. 16D, a center beam through hole 43G is formed to have an almost rectangular shape having a horizontal long side. However, each of a pair of side beam through holes 43B and 43R is formed to have a horizontally elongated shape in which both sides in the horizontal direction are constituted by arcs respectively having radii R1 and R2 and these arcs are connected with straight lines. The length of the inner arc on the center beam through hole 43G side is smaller than that of the outer arc. The radii R1 and R2 of the arcs of each of the pair of side beam through holes 43B and 43R may satisfy the following equation:

$$R1=R2$$

The radius R1 of the inner arc on the center beam through hole 43G side may be set to be smaller than the radius R2 of the outer arc, i.e., the following condition may be satisfied:

$$R1<R2$$

The center of the radius R1 need not necessarily coincide with that of the radius R2. In addition, the horizontal centers of the pair of side beam through holes 43B and 43R are slightly decentered outward by ΔSg in the horizontal direction with respect to the centers of the side beam through holes 42B and 42R of the seventh grid G7. Three electron beam through holes arranged in a line in the arrangement direction of the three electron beams and each having a size almost equal to each of the electron beam through holes in the seventh grid G7 are formed in each of the opposing surfaces of the eighth grid G8 and the convergence cup Cp.

In this electron gun assembly, each of the bath-tub electrode G54 of the fifth grid G5 on the sixth grid G6 side and the bath-tub electrode G81 of the eighth grid G8 on the seventh grid G7 side is formed to have a horizontally elongated shape in which a vertical diameter perpendicular to the arrangement direction of the three electron beam through holes is larger than that of each of the bath-tub electrodes G51, G52, G53, and G82 of the fifth and eighth grids G5 and G8, thereby obtaining the operation of the electric-field correction electrode of the first embodiment shown in FIGS. 8A and 8B.

In this electron gun assembly, for example, a voltage obtained by adding a video signal voltage to a cutoff voltage of 100 to 200 V is applied to the cathodes KB, KG, and KR, and the first grid G1 is set to be a ground potential. The second and fourth grids G2 and G4 are connected to each other in a tube, and a voltage of 500 to 1,000 V is applied to these electrodes. The third and fifth grids G3 and G5 are connected to each other in the tube, and a voltage of 5 to 10 kV is applied to these electrodes. A positive high voltages of 20 to 35 kV is applied to the eighth grid G8. The positive high voltage applied to the eighth grid G8 is divided by the resistor 38, and a voltage of 30 to 50% of the positive high voltage and a voltage of 50 to 80% of the positive high voltage are applied to the sixth and seventh grids G6 and G7, respectively.

Figure 17:
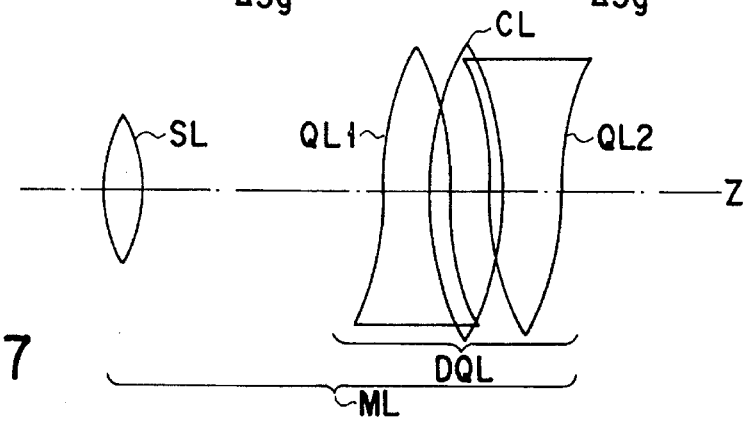
FIG. 17 is a schematic view showing the optical system of electron lenses formed at the main electron lens section of the electron gun assembly shown in FIGS. 15A and 15B.

As described above, in this electron gun assembly, the electron beam forming section GE for controlling electron emission from the cathodes KB, KG, and KR and focusing emitted electrons to form three electron beams arranged in a line is formed by the cathodes KB, KG, and KR and the first to third grids G1 to G3 sequentially adjacent to the cathodes KB, KG, and KR, and the main electron lens section ML for focusing and converging the three electron beams obtained by the electron beam forming section GE on the phosphor screen is formed by the third to eighth grids G3 to G8. This main electron lens section ML, as shown in FIG. 17, is constituted by a preliminary focus lens SL and a diffused electric-field type double quadrupole lens DQL. The preliminary focus lens SL slightly focuses the electron beams from the electron beam forming section GE and is formed between the third and fifth grids. The extended electric-field type double quadrupole lens DQL includes a lens operation constituted by a quadrupole lens component QL1, formed between the fifth and sixth grids, for vertically focusing and horizontally diverging the electron beams, a focus lens component CL, formed between the sixth and seventh grids, for horizontally and vertically focusing the electron beams, and a quadrupole lens component QL2, formed between the seventh and eighth grids, for vertically diverging and horizontally focusing the electron beams, i.e., includes the two quadrupole lens components QL1 and QL2 having different polarities.

Figure 18A:
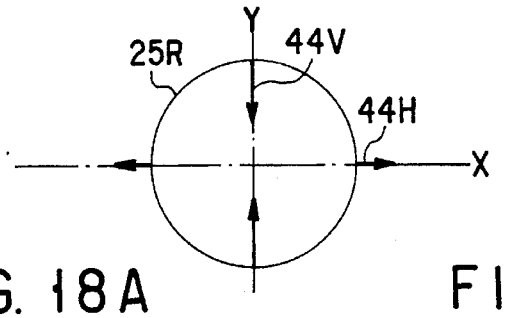
FIGS. 18A, 18B, 18C, 18D, and 18E are views for respectively explaining the operations of the lens components of electron lenses formed between the fifth and eighth grids of the electron gun assembly shown in FIGS. 15A and 15B.
Figure 18D:
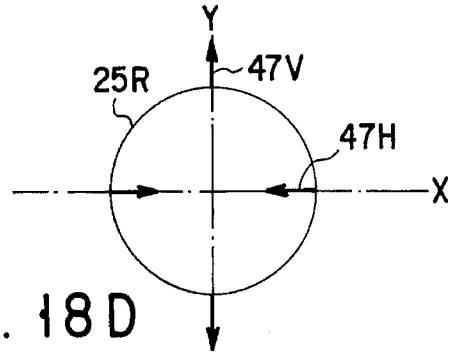
Figure 18B:
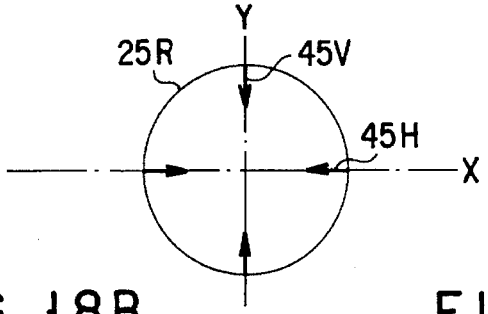

When the extended electric-field type double quadrupole lens DQL is formed at the main electron lens section ML as described above, as shown in FIG. 18A with respect to a side beam 25R, the side beam 25R is influenced by a horizontal divergence operation indicated by an arrow 44H and a vertical focus operation indicated by an arrow 44V by the quadrupole lens component QL1 formed between the fifth and sixth grids. As indicated by arrows 45H and 45V in FIG. 18B, the side beam 25R is influenced by horizontal and vertical focus operations in the direction of the center of the electron beam. As indicated by arrows 46H1, 46H2, 46V1 and 46V2 in FIG. 18C, a prism operation for deflecting the side beam 25R to cause the side beam 25R to be close to the center beam is obtained by the quadrupole lens component QL2 formed between the seventh and eighth grids. In addition, since the side beam through holes of the eighth grid for forming the quadrupole lens component QL2 are formed as shown in FIG. 16D, the side beam 25R is influenced by a horizontal focus operation indicated by an arrow 47H and a vertical divergence operation indicated by an arrow 47V, as shown in FIG. 18D.

Figure 18E:
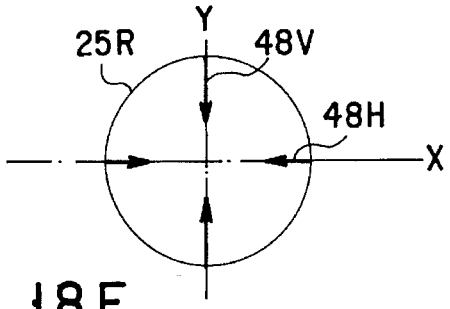
Figure 18C:
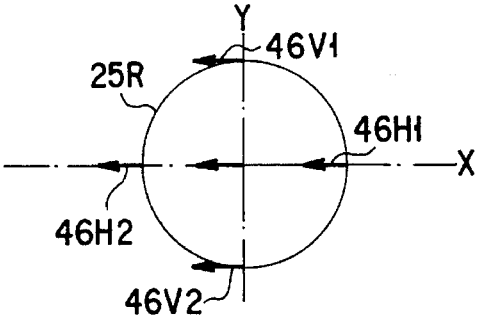
Figure 19A:
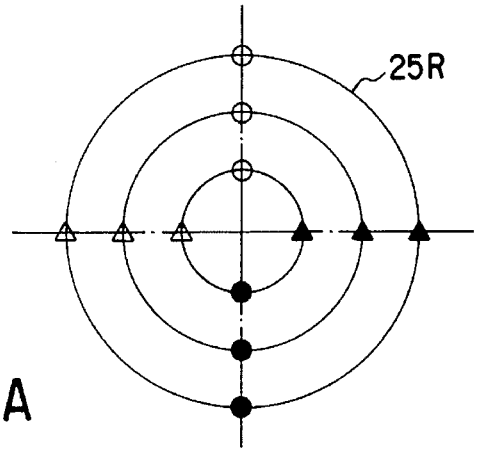
FIGS. 19A and 19B are views for respectively explaining the shapes of beam spots formed on a phosphor screen by the electron lenses formed between the fifth and eighth grids of the electron gun assembly shown in FIGS. 15A and 15B.
Figure 19B:
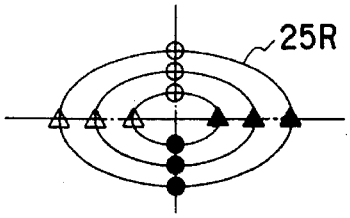

As a result, the side beam 25R, as shown in FIG. 18E, is influenced by a horizontal focus operation indicated by an arrow 48H and a vertical focus operation indicated by an arrow 48V by a lens operation obtained by synthesizing the lens components except for the prism operation, and the rotationally symmetrical side beam 25R free from distortion as shown in FIG. 19A can be focused and converged on a phosphor screen to have an arc-like shape free from distortion as shown in FIG. 19B. Similarly, a side beam 25B can be focused and converged on the phosphor screen to have a rotationally symmetrical arc-like shape free from distortion.

Therefore, when the electron gun assembly is arranged as described above, a color cathode ray tube apparatus is obtained which can properly focus three electron beams arranged in a line and passing through the same horizontal plane and obtain good image characteristics over the entire screen.

In the first and second embodiments, of the electron beam through holes in the opposing surfaces of the third and fourth grids constituting the main electron lens section, each of the pair of side beam through holes of any one of the electrodes is formed to have a horizontally elongated shape in which both sides in the arrangement direction of the three electron beams are constituted by arcs. However, even when each of the pair of side beam through holes in each of the opposing surfaces of the third and fourth grids is formed to have a horizontally elongated shape in which both sides in the arrangement direction of the three electron beams are constituted by arcs, the synthesized asymmetrical electron lens component can be used as an electron lens operating as orthogonal quadrupole lens components. Therefore, a color cathode ray tube apparatus is obtained which can properly focus the three electron beams on the phosphor screen to form a beam spot free from distortion and obtains good image characteristics.

Figure 20A:
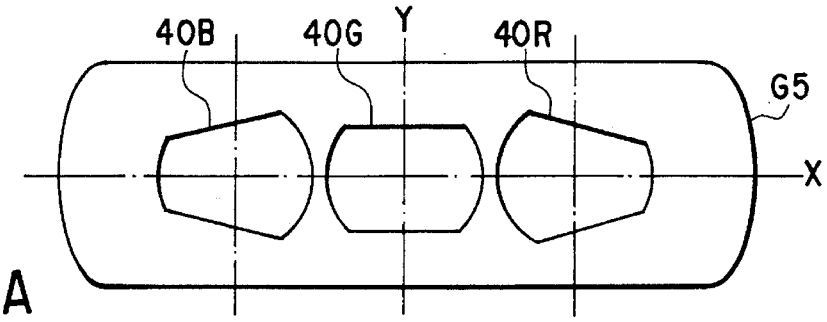
FIGS. 20A and 20B are views respectively showing other shapes of the fifth and eighth grids of the electron gun assembly shown in FIGS. 15A and 15B, respectively.
Figure 20B:
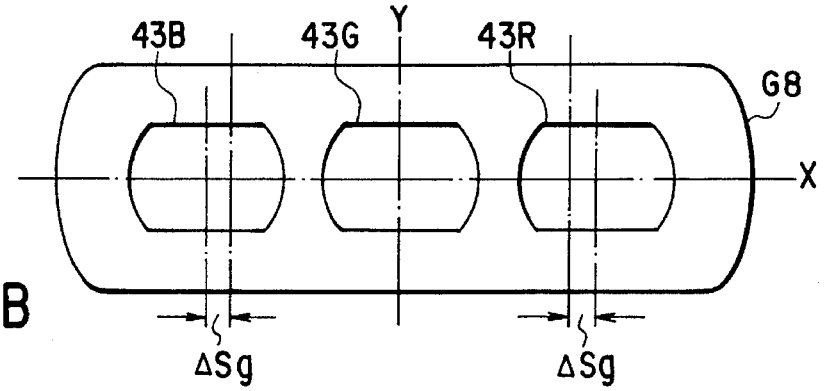

In the third embodiment, each of the three electron beam through holes in the surface of the fifth grid opposing the sixth grid is formed to have a rectangular shape having a long side in the arrangement direction of the three electron beams (see FIG. 16A). Of the electron beam through holes in the surface of the eighth grid opposing the seventh grid, the center beam through hole is formed to have a rectangular shape having a long side in the arrangement direction of the three electron beams, and each of the pair of side beam through holes is formed to have a horizontally elongated shape in which horizontal both sides are constituted by arcs (see FIG. 16D). However, the electron beam through holes in the surface of the fifth grid opposing the sixth grid, as shown in FIG. 20A, may be constituted by a center beam through hole 40G having an almost rectangular shape having a long side in the arrangement direction of the three electron beams and side beam through holes 40B and 40R each having a horizontally elongated shape in which both sides in the arrangement direction of the three electron beams are constituted by arcs respectively having radii R1 and R2 (R1=R2 or R1>R2) and the length of the inner arc on the center beam through hole 40G side is larger than that of the outer arc. Of the electron beam through holes in the surface of the eighth grid opposing the seventh grid, as shown in FIG. 20B, each of three electron through holes 43B, 43G, and 43R may be formed to have a rectangular shape having a horizontal long side, and the center of each of the pair of side beam through holes 43B and 43R may be horizontally decentered outward by $\Delta Sg$ with respect to a corresponding one of the centers of the pair of side beams in the surface of the seventh grid opposing the eighth grid.

Figure 21A:
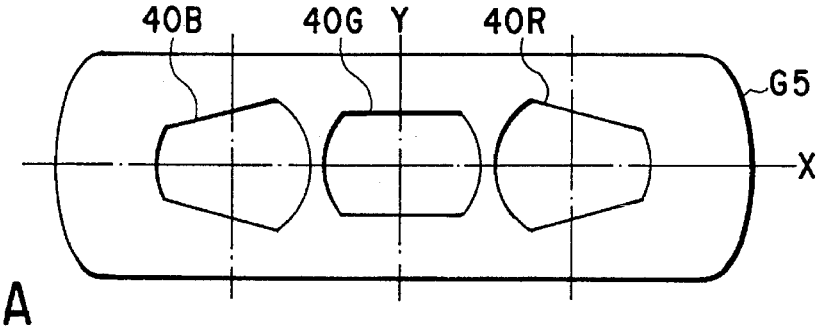
FIGS. 21A and 21B are views respectively showing still other shapes of the fifth and eighth grids of the electron gun assembly shown in FIGS. 15A and 15B.
Figure 21B:
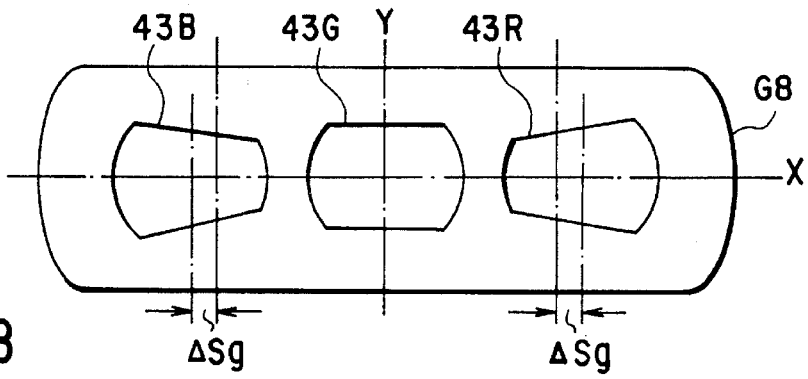

In the third embodiment, the electron beam through holes in the surface of the fifth grid opposing the sixth grid, which grids constitute the main electron lens section, as shown in FIG. 21A, may be constituted by a center beam through hole 40G having an almost rectangular shape having a horizontal long side and side beam through holes 40B and 40R each having a horizontally elongated shape in which both sides in the arrangement direction of the three electron beams are constituted by arcs respectively having radii R1 and R2 (R1=R2 or R1>R2) and the length of the inner arc on the center beam through hole 40G side is larger than that of the outer arc. The electron beam through holes in the surface of the eighth grid opposing the seventh grid, as shown in FIG. 21B, may be constituted by a center beam through hole 43G having an almost rectangular shape having a horizontal long side and side beam through holes 43B and 43R each having a horizontally elongated shape in which both horizontal sides are constituted by arcs respectively having radii R1 and R2 (R1=R2 or R1<R2) and the length of the inner arc on the center beam through hole 43G side is smaller than that of the outer arc. In addition, the center of each of the pair of side beam through holes 43B and 43R may be horizontally decentered outward by $\Delta Sg$ with respect to a corresponding one of the centers of the pair of side beams in the surface of the seventh grid opposing the eighth grid.

In the above embodiments, a bi-potential type electron gun assembly and an electron gun assembly for forming a diffused electric-field type electron lens have been described. However, when the present invention is applied to a uni-potential type electron gun assembly or a composite type electron gun assembly obtained by combining uni-potential type electron gun assemblies to each other, a color cathode ray tube apparatus which can obtain the same effect-as described above can be obtained.

Each of a pair of side beam through holes of any one of a first electrode having a relatively low potential and a second electrode having a relatively high potential, which electrodes substantially oppose and constitute the main electron lens section of an electron gun assembly, is formed to have a substantially horizontally elongated shape in which both sides in the arrangement direction of three electron beams are constituted by arcs and the lengths of the inner and outer arcs in the arrangement direction of the three electron beams are different from each other. More specifically, each of the pair of side beam through holes of the first electrode is formed to have a substantially horizontally elongated shape, the length of the inner arc of each of the pair of side beam through holes in the arrangement direction of the three electron beams is set to be larger than that of the outer arc, or each of the pair of side beam through holes of the second electrode is formed to have a substantially horizontally elongated shape, and the length of the inner arc of each of the pair of side beam through holes in the arrangement direction of the three electron beams is set to be smaller than that of the outer arc. In this case, an electric field permeated between the first and second electrodes and into these electrodes are uniformed, an asymmetrical electron lens having excellent orthogonality and a small non-orthogonal asymmetrical lens component can be formed, and the three electron beams arranged in a line can be properly focused on a phosphor screen, thereby obtaining good image characteristics of the entire screen.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A color cathode ray tube apparatus comprising:

means for generating three electron beams arranged in a line and constituted by a center beam and a pair of side beams passing through the same plane;

a phosphor screen on which the electron beams are incident to generate light beams;

an electrode structure having at least first and second electrodes each of which has three electron beam holes formed in each of opposing surfaces of said first and second electrodes, including a center beam through hole and a pair of side beam through holes, arranged in a line in the arrangement direction of the three electron beams, the pair of side beam through holes of said second electrode being off-centered outward, in the arrangement direction of the three electron beams, with respect to the pair of side beam through holes of said first electrode, each of said pair of side beam through holes of said first electrode having a shape different from that of each of said pair of side beam through holes of said second electrode, each of the pair of side beam through holes of said first electrode being formed to have a substantially horizontally elongated shape in which the sides, in the arrangement direction of the three electron beams, comprise inner and outer arc-like shapes such that the length of the inner arc-like shape is larger than the length of the outer arc-like shape, thereby forming, between said first and second electrodes, an electron lens having a quadrupole lens component for vertically focusing the pair of side beams;

potential applying means for applying a first potential to said first electrode and applying a second potential relatively higher than the first potential to said second electrode to form a main electron lens for focusing the electron beams on said phosphor screen between said first and second electrodes; and deflection means for deflecting the three electron beams arranged in a line to horizontally and vertically scan said phosphor screen.

2. A color cathode ray tube apparatus comprising:

means for generating three electron beams arranged in a line and constituted by a center beam and a pair of side beams passing through the same plane;

a phosphor screen on which the electron beams are incident to generate light beams;

an electrode structure having at least first and second electrodes each of which has three electron beam holes formed in each of opposing surfaces of said first and second electrodes, including a center beam through hole and a pair of side beam through holes, arranged in a line in the arrangement direction of the three electron beams, the pair of side beam through holes of said second electrode being off-centered outward, in the arrangement direction of the three electron beams, with respect to the pair of side beam through holes of said first electrode, each of said pair of side beam through holes of said first electrode having a shape different from that of each of said pair of side beam through holes of said second electrode, each of the pair of side beam through holes of said second electrode being formed to have a substantially horizontally elongated shape in which the sides, in the arrangement direction of the three electron beams, comprise inner and outer arc-like shapes such that the length of the inner arc-like shape is smaller than the length of the outer arc-like shape, thereby forming, between said first and second electrodes, an electron lens having a quadrupole lens component for vertically diverging the pair of side beams;

potential applying means for applying a first potential to said first electrode and applying a second potential relatively higher than the first potential to said second electrode to form a main electron lens for focusing the electron beams on said phosphor screen between said first and second electrodes; and deflecting means for deflecting the three electron beams arranged in a line to horizontally and vertically scan said phosphor screen.

3. A color cathode ray tube apparatus according to claim 1, wherein each of the pair of side beam through holes of said second electrode is formed to have a substantially circular shape.

4. A color cathode ray tube apparatus according to claim 1, wherein each of the pair of side beam through holes of said second electrode is formed to have a substantially elongated rectangular shape.

5. A color cathode ray tube apparatus according to claim 1, further comprising intermediate electrodes located between said first and second electrodes and having center and side beam through holes, each of the center and side beam through holes of said intermediate electrodes being formed to have a substantially circular shape.

6. A color cathode ray tube apparatus according to claim 1, wherein each of the pair of side beam through holes of said second electrode is formed to have a substantially horizontally elongated shape in which the sides, in the arrangement direction of the three electron beams, comprise inner and outer arc-like shapes such that the length of the inner arc-like shape is smaller than the length of the outer arc-like shape.

7. A color cathode ray tube apparatus according to claim 2, wherein each of the pair of side beam through holes of said first electrode is formed to have a substantially circular shape.

8. A color cathode ray tube apparatus according to claim 2, wherein each of the pair of side beam through holes of said first electrode is formed to have a substantially elongated rectangular shape.

9. A color cathode ray tube apparatus according to claim 2, further comprising intermediate electrodes located between said first and second electrodes and having center and side beam through holes, each of the center and side beam through holes of said intermediate electrodes being formed to have a substantially circular shape.

10. A color cathode ray tube apparatus according to claim 2, wherein each of the pair of side beam through holes of said second electrode is formed to have a substantially horizontally elongated shape in which the sides, in the arrangement direction of the three electron beams, comprise inner and outer arc-like shapes such that the length of the inner arc-like shape is smaller than the length of the outer arc-like shape.

* * * * *